US006117492A

United States Patent [19]

Goldstein et al.

[11] Patent Number: 6,117,492

[45] Date of Patent: Sep. 12, 2000

[54] POLYMERS HAVING DUAL CROSSLINKABLE FUNCTIONALITY AND PROCESS FOR FORMING HIGH PERFORMANCE NONWOVEN WEBS

[75] Inventors: Joel Erwin Goldstein, Allentown; Ronald Joseph Pangrazi, Fleetwood, both of Pa.

[73] Assignee: Air Products and Chemicals, Inc., Allentown, Pa.

[21] Appl. No.: 09/281,016

[22] Filed: Mar. 30, 1999

[51] Int. Cl.[7] ..... B05D 3/00

[52] U.S. Cl. ..... 427/391; 427/392; 427/393.4

[58] Field of Search ..... 427/389.9, 391, 427/392, 393.4

[56] References Cited

U.S. PATENT DOCUMENTS

| | | | |
|---|---|---|---|
| 3,806,498 | 4/1974 | Wilson et al. . | |
| 4,278,578 | 7/1981 | Carpenter . | |
| 4,605,698 | 8/1986 | Briden . | |
| 4,645,789 | 2/1987 | Dabi . | |
| 5,087,603 | 2/1992 | Izubayashi et al. | 503/226 |
| 5,426,129 | 6/1995 | Emmons et al. . | |
| 5,451,653 | 9/1995 | Chen et al. . | |
| 5,534,310 | 7/1996 | Rokowski et al. . | |
| 5,605,953 | 2/1997 | Esser . | |

FOREIGN PATENT DOCUMENTS 1-297429 11/1989 Japan .

OTHER PUBLICATIONS translation of JP 01–297429, Nov. 1989.

Publication by Kodar re: Acetoacetoxyethyl Methacrylate (AAEM) and Acetoacetyl Chemistry, Oct. 1988.

*Primary Examiner*—Erma Cameron
*Attorney, Agent, or Firm*—Michael Leach

[57] ABSTRACT

This invention relates to polymers particularly suited for use in preparing high quality nonwoven products. The binders for the banquet incorporate at least two different but reactive functionalities and which are capable of reacting with two other multifunctional reactants each of which will react with at least one of the functionalities present in the polymer. The two functionalities copolymerized into these backbones include the acetoacetoxy moiety and a carboxylic acid group. The crosslinking is effected by adding a compound capable of reacting and crosslinking the acetoacetoxy moiety and another compound capable of reacting and crosslinking the carboxylic acid functionality. The former can be a dialdehyde such as glyoxal or glutaraldehyde. The second functionality is a polyaziridine functional compound such as N-aminoethyl-N-aziridilethylamine, N,N-bis-2-aminopropyl-N-aziridilethylamine, N-3,6,9-triazanonylaziridine, the bis and tris aziridines of di and tri acrylates of alkoxylated polyols, the trisaziridine of the triacrylate of the adduct of glycerine and propylene oxide.

16 Claims, No Drawings

POLYMERS HAVING DUAL CROSSLINKABLE FUNCTIONALITY AND PROCESS FOR FORMING HIGH PERFORMANCE NONWOVEN WEBS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Crosslinking systems for effecting cure of emulsion polymers are used to provide nonwoven articles, particularly cellulosic webs such as paper towels, with some desired property such as water or solvent resistance. Most crosslinking systems for emulsion polymers which are employed today require temperatures in excess of 100° C. to ensure the development of a decently cured system. While high temperature cures may be acceptable for many applications, such temperatures may be unacceptable in other applications because of an unsuitability of certain types of substrates, operational difficulties, and lastly, they may represent economic hardship due to the high cost of energy.

In the manufacture of paper towels by the double recreping process (DRC process) that deficiency is even more profound. In the DRC process, a basestock of paper is printed on one side with a polymeric binder, flash dried, creped, and printed on the second side, flash dried, and recreped and collected on a roller into a ream of paper. These line rolls run at over 1500 ft/minute. The current process requires a bank of dryers before collecting to cure the binder and prevent blocking, i.e., the tendency of one sheet to stick to an upper or lower layer. The industry wishes to move away from the use of a cure oven and its inherent cost of capital and energy. To make this practical, the binder must cure at ambient condition, i.e., it must cure in an extremely short time, e.g., within a second to 2 minutes, rather than the weeks required for curing vinyl trisisopropoxy silane (VTIPS).

One type of crosslinking system employed for polymeric binders includes a crosslinking mechanism based upon the use of pendent acetoacetate functionality such as that derived by the polymerization of acetoacetoxyethyl methacrylate (AAEM) into the polymer and a polyfunctional reactant therewith. The acetoacetate containing polymer then can be reacted with a multi-primary amine functional moiety, for example, to effect crosslinking. This combination has a very short pot-life and often requires the addition of a blocking agent which tend to severely retard cure.

Another type of crosslinking functionality for polymeric binders is based upon the reaction of carboxyl functionality and a polyaziridine.

The following patents are representative of acetoacetate chemistry in the crosslinking of polymeric emulsions.

U.S. Pat. No. 5,534,310 discloses a method for improving adhesive durable coatings on weathered substrates. The durable coatings are based upon latex binders formed by the polymerization of acrylic and methacrylic esters, such as methyl methacrylate, ethyl acrylate, butyl acrylate, 2-ethylhexyl acrylate, etc., along with vinyl monomers and the like. Durability is enhanced by incorporating acetoacetate functionality into the polymer, typically by polymerization of monomers such as acetoacetoxyethyl methacrylate, acetoacetoxyethyl acrylate (AAEA), allyl acetoacetate, and vinyl acetoacetate. Enamine functionality is incorporated into the polymer for improving adhesion by reaction of the latex containing the acetoacetate functionality with ammonia or an amine.

U.S. Pat. No. 5,426,129 discloses a coating or impregnating composition based on a vinyl addition polymer containing acetoacetate groupings or an enamine. The vinyl addition polymers are based upon the polymerization of a variety of monomers including acrylic and methacrylic acid esters and ethylenically unsaturated monomers such as vinyl acetate, vinyl chloride, etc. A reactive-coalescent is incorporated into the polymer, and these coalescents include monomers such as acetoacetoxyethyl methacrylate and the corresponding enamines which are obtained by reaction with ammonia or ethanolamine.

U.S. Pat. No. 5,451,653 discloses a curable crosslinking system based upon an aldimine/acetoacetate crosslinker. The polymer is a water-based, crosslinkable polymer having utility in industry as a coating or adhesive and is based on the polymerization of a variety of monomers including acrylic and methacrylic acid esters as well as vinyl acetate and other ethylenically unsaturated monomers. Acetoacetate functionality is incorporated into the water-based, crosslinkable polymer by one of two techniques, the preferred being the incorporation via polymerization of acetoacetoxyethyl methacrylate. The acetoacetate functionality is crosslinked by reaction with an aldimine formed by the reaction of an aldehyde and an amine.

A publication by Kodak regarding acetoacetoxyethyl methacrylate and acetoacetyl chemistry discloses the synthesis of polymer systems incorporating acetoacetoxyethyl methacrylate for decreasing solution viscosity and lowering glass transition temperature as well as providing a mechanism for crosslinking the polymer systems. A variety of reactions of acetoacetylated containing polymers is shown as, for example, reaction of a polymer having pendent acetoacetate functionality with melamine, an isocyanate, an aldehyde, or an electron-deficient olefin through a Michael reaction.

U.S. Pat. No. 5,605,953 discloses polymeric systems incorporating both acetoacetoxy functional and amine functional moieties as well as acetoacetoxy and acid functional moieties for providing crosslinked coatings and films. Crosslinking is effected through the use of amines.

The following patents describe crosslinking systems based upon polyfunctional aziridines.

U.S. Pat. No. 4,645,789 discloses the use of highly crosslinked polyelectrolytes for use in diapers and dressings which are based upon acrylic acid-acrylate copolymers, acrylic acid-acrylamide copolymers, acrylic acid and vinyl acetate copolymers, and so forth. Preferred aziridines include the triaziridines based upon trimethylolpropane tripropionates, tris(1-aziridinyl)phosphine oxide, and tris(1-aziridinyl)-phosphine sulfide.

U.S. Pat. No. 4,605,698 discloses the use of polyfunctional aziridines in crosslinking applications. One type of polyaziridine is based upon the reaction of ethylene imine with acrylates of an alkoxylated trimethylolpropane or other polyol. Vinyl acetate/carboxylated urethanes and styrene/acrylics are shown as being crosslinked with polyfunctional aziridines to produce coatings having a low temperature crosslinking functionality.

U.S. Pat. No. 4,278,578 discloses coating compositions for plastic substrates based upon carboxy functional acrylic copolymers which are crosslinked with from about 0.2 to 3% of a polyfunctional aziridine. Carboxy functional acrylic and methacrylic copolymers are for use in maintaining the appearance of wooden floors and the durability of vinyl and other resilient floor coverings. The crosslinking agents are used for effecting crosslinking of the acrylic and carboxyl functional copolymers. Examples include N-aminoethyl-N-aziridylethylamine with a most preferred aziridine being a trifunctional aziridine having equivalent weight of 156 atomic mass units sold under the trademark designation Neocryl CX100 by Polyvinyl Chemical Industries (now by Zeneca Corporation).

U.S. Pat. No. 3,806,498 discloses the use of (1-aziridinyl) alkyl curing agents for acid-terminated polymers. A wide variety of polymers having terminal-free acid groups are described as being crosslinkable through the use of the (1-aziridinyl)alkyl curing agents, and these include those formed by the reaction of esters of carboxylic saturated and unsaturated acids with aziridinyl alcohols.

BRIEF SUMMARY OF THE INVENTION

The invention relates to polymeric binders having dual crosslinkable functionalities which permit full cure under ambient or reduced temperature (20 to 40° C.) conditions as compared to conventional acetoacetylated/amine systems. In addition to low temperature curing, the polymeric binders impart excellent solvent and water resistant properties. The invention also relates to processes for producing high performance webs, particularly cellulosic such as paper, incorporating the polymeric binders.

In achieving the above, at least two different but reactive functionalities which are capable of reacting with two other multifunctional reactants, each of which will react with at least one of the functionalities present in the polymer are employed. The two functionalities copolymerized into the polymeric backbone include the acetoacetoxy moiety and a carboxylic acid group. Dual crosslinkability is effected by adding a polyfunctional compound capable of reacting with the acetoacetoxy moiety and adding a polyfunctional compound capable of reacting with the carboxylic acid functionality. The former polyfunctional compound capable of reacting with the acetoacetoxy moiety is a polyaldehyde, preferably a dialdehyde such as glyoxal or glutaraldehyde. The second functionality capable of reacting with the carboxyl functionality is a polyaziridine functional compound.

There are significant advantages to the dual crosslinkable polymeric emulsions described herein and these include:

- an ability to effect a cure sufficient to approach target performance requirements as currently achieved by a thermally activated system based on aminoplast technology in the formation of high performance paper towels;
- an ability to achieve sufficient cure such that the there is essentially no blocking of product when wound upon itself;
- a polymeric emulsion eminently workable at the site of use, i.e., a plant can prepare this formulation and have over 4 hours of pot-life in which to coat or spray or print the polymeric emulsion onto the substrate of choice;
- an ability to control crosslink density by controlling the level of external crosslinking agents either through addition or reduction of reactants;
- an ability to operate free of formaldehyde; and
- an ability to operate with reduced energy costs due to the elimination of a bake cycle required for most crosslinking systems after removal of water.

BRIEF DESCRIPTION OF SEVERAL VIEWS OF THE DRAWINGS

Not applicable.

DETAILED DESCRIPTION OF THE INVENTION

The aqueous emulsion polymers of this invention are produced by emulsion polymerization methods with the proviso that the polymers have at least two functional moieties in the molecule, one being acetoacetate and the other being carboxylic acid. These two functionalities provide the basis for dual crosslinkability. The dual crosslinkable function is based upon the reaction of the acetoacetate with a dialdehyde and the reaction of the carboxyl functionality with a polyazyridine. Dual crosslinkability provides a measure of performance to the polymeric emulsion thereby leading to its versatility in processes such as recreping in paper towel formation and so forth.

Two types of techniques generally have been utilized in preparing polymeric components having activated acetoacetate functionality. One technique involves the addition polymerization of an ethylenically unsaturated monomer having at least one acetoacetate group via solution, emulsion or suspension polymerization. Examples of preferred ethylenically unsaturated monomers capable of providing acetoacetate functionality include acetoacetoxyethyl acrylate (AAEA), allyl acetoacetate, vinyl acetoacetate, acetoacetoxyethyl methacrylate (AAEM) and N-acetoacetylacrylamide. A second technique for preparing the polymeric component having acetoacetate functionality involves the solution or emulsion polymerization of monomers capable of forming polymers having pendant functional groups convertible to acetoacetate units. The use of hydroxyl functional monomers, e.g., hydroxy acrylates, is one way of forming these polymers. Pendent hydroxyl groups then can be converted to acetoacetate units by reaction with an alkyl acetoacetate, e.g., t-butyl acetoacetate or by reaction with diketene.

Carboxylic acid functionality can be incorporated into the polymer in a variety of ways well known in polymerization technology. A conventional mechanism is in the polymerization of a carboxyl functional monomer with other monomers in polymer formation. Representative carboxyl functional monomers include acrylic and methacrylic acid, crotonic acid, carboxyl ethyl acrylate, maleic anhydride, itaconic acid, and so forth.

The acetoacetate and carboxyl functional monomers can be polymerized with a variety of ethylenically unsaturated monomers having limited to no reactive functionality to form the base polymers. These monomers include $C_{1-13}$ alkyl esters of acrylic and methacrylic acid, preferably $C_{1-8}$ alkyl esters of (meth)acrylic acid, which include methyl methacrylate, ethyl acrylate, butyl acrylate, hexyl acrylate, 2-ethylhexyl acrylate, isooctyl acrylate, isodecyl acrylate and the like; vinyl esters such as vinyl acetate and vinyl propionate; vinyl chloride, acrylonitrile; hydrocarbons such as ethylene, butadiene, styrene, etc.; mono and diesters of maleic acid or fumaric acid, the mono and diesters being formed by the reaction of maleic acid or fumaric acid with a $C_{1-13}$ alkanol, preferably a $C_{8-13}$ alkanol such as, n-octyl alcohol, i-octyl alcohol, butyl alcohol, isobutyl alcohol, methyl alcohol, amyl alcohol (dibutyl maleate is preferred); $C_{1-8}$ alkyl vinyl ethers such as methyl vinyl ether, ethyl vinyl ether, isopropyl vinyl ether, n-propyl vinyl ether, tert-butyl vinyl ether and n- and isobutyl vinyl ether and alpha, beta-ethylenically unsaturated $C_{3-6}$ carboxylic acids and vinyl esters can also be employed. Also vinyl esters of $C_{8-13}$ neo-acids which are comprised of a single vinyl ester or mixture of tri- and tetramers which have been converted to the corresponding single or mixture of $C_{8-13}$ neo-acids may be polymerized.

In producing the relatively ambient temperature dual crosslinkable polymer, the polymer should incorporate from about 1 to 10% preferably 2 to 5% by weight of the acetoacetate functionality as measured relative to the molecular weight of acetoacetoxyethyl methacrylate and based upon the total weight of the polymer. (For monomers other than acetoacetoxyethyl methacrylate, acetoacetate functionality should be relative to the molecular weight of acetoacetoxyethyl methacrylate.) Increasing the level of acetoacetoxyethyl methacrylate or molar equivalent in the polymer beyond about 10% and generally even above about 8% by weight of the polymer may lead to an unstable emulsion or require additional stabilizing surfactant. The latter reduces water resistance. In addition thereto, the system may require an increased level of external crosslinker to effect crosslinking. That increased level too may result in an unstable formulation. Given that the preferred monomer employed in forming the acetoacetate containing polymer is acetoacetoxyethyl methacrylate, the preferred percentage level for polymerized units of acetoacetoxyethyl methacrylate (AAEM) by weight is from 4–8% by weight of the polymer.

Representative Compositions are set forth in the following table.

| Monomer | Broad wt % | Preferred wt % |
|---|---|---|
| Vinyl Acetate | 0–90 | 35–85 |
| (Meth)Acrylic Acid | 1–10 | 3–8 |
| Acetoacetoxyethyl (Meth)ethacrylate | 2–10 | 4–8 |
| $C_{1-8}$ alkyl (Meth)Acrylic Ester | 0–90 | 0–40 |

As a further means of characterizing the polymers, the following table is provided:

Preferred polymer components are based upon the following formulations:

| Monomer | Broad wt % | Preferred wt % |
|---|---|---|
| (meth)acrylic acid | 1–10 | 3–7 |
| methacrylate | 10–30 | 15–25 |
| ethyl or butyl acrylate | 40–75 | 55–65 |
| acetoacetoxy ethyl methacrylate | 2–10 | 5–8 |

The sum of the monomer percent must equal 100%.

The polymers should have a Tg of from about −5 to +10° C. and a Mw of from 200,000 to 225,000 and an Mn of from 7,500 to 10,000.

In forming polymers having dual crosslink functionality, the operative level for the carboxylic acid functionality in the polymer typically is from 1–8 weight percent carboxyl functionality based upon the total weight of the polymer. (For monomers other than acrylic acid carboxylic acid functionality is measured relative to the molecular weight of acrylic acid.) Preferably, the carboxylic acid containing comonomer is incorporated into the polymer in a preferred percentage range from 2–5% by weight.

Polymerization can be initiated by thermal initiators or by a redox system. A thermal initiator is preferred at temperatures at or above about 70° C. and redox systems are preferred when the polymerization temperature is below about 70° C. is used. The viscoelastic properties are influenced by small changes in temperature and by initiator composition and concentration. The amount of thermal initiator used in the process is 0.1 to 3 wt %, preferably from 0.5 to 1.5wt %, based on total monomers. Thermal initiators are well known in the emulsion polymer art and include, for example, ammonium persulfate, sodium persulfate, and the like. The amount of oxidizing and reducing agent in the redox system is about 0.1 to 3 wt %. Any suitable redox system known in the art can be used; for example, the reducing agent can be a bisulfite, a sulfoxylate, ascorbic acid, erythorbic acid, and the like. The oxidizing agent can include, persulfates, azo compounds, and the like.

The reaction time will also vary depending upon other variables such as the temperature, the catalyst, and the desired extent of the polymerization. It is generally desirable to continue the reaction until less than 0.5% of the vinyl ester remains unreacted. Under these circumstances, a reaction time of about 6 hours has been found to be generally sufficient for complete polymerization, but reaction times ranging from 2 to 10 hours have been used, and other reaction times can be employed, if desired.

The stabilizing system employed for emulsion polymerization typically consists of 0.5–5 wt %, of a surfactant or a blend of surfactants based on the weight of total monomers charged to the system. The surfactants contemplated for the invention include any of the known and conventional surfactants and emulsifying agents, principally the nonionic and anionic materials, heretofore employed in the emulsion copolymerization of vinyl acetate polyalkoxylated surfactants being especially preferred. Among the nonionic surfactants found to provide good results are the ethoxylated secondary alcohols such as the Igepal surfactants supplied by Rhodia and Tergitols supplied by Union Carbide. The Igepal surfactants are members of a series of alkylphenoxy-poly(ethyleneoxy)ethanols having alkyl groups containing from about 7–18 carbon atoms, and having from about 4 to 100 ethyleneoxy units, such as the octylphenoxy poly (ethyleneoxy)ethanols, nonylphenoxy poly(ethyleneoxy) ethanols, and dodecylphenoxy poly(ethyleneoxy)ethanols. Examples of nonionic surfactants include polyoxyalkylene derivatives of hexitol (including sorbitans, sorbides, manitans, and mannides) anhydride, partial long-chain fatty acid esters, such as polyoxyalkylene derivatives of sorbitan monolaurate, sorbitan monopalmitate, sorbitan monostearate, sorbitan tristearate, sorbitan monooleate and sorbitan trioleate. Examples of anionic surfactants include sulfosuccinates, e.g., sodium dioctyl sulfosuccinate.

The use of protective colloids such as polyvinyl alcohol and hydroxyethyl cellulose as a component of the stabilizing system can also be used. The presence of conventional levels of polyvinyl alcohol, e.g., 1 to 3% based upon monomers in the polymerization may be used. Polyvinyl alcohol formed by the hydrolysis of polyvinyl acetate having a hydrolysis value of from 85 to 99 mole % is preferred.

Crosslinking of the polymer having acetoacetate and carboxyl functionality is achieved by reaction with at least two multifunctional reactants one capable of reacting with the acetoacetate functionality and another with the carboxyl functionality. One of the multifunctional components is a polyaldehyde and preferably a dialdehyde, the other multifunctional component is a polyaziridine. The operative level of each is controlled such that generally at least an effective amount or a stoichiometric amount is added to react with the acetoacetate and carboxyl functionality of the polymer and effect dual crosslinking. To drive the reaction to completion in a short time as required on the production line, an excess of one of the reactants is employed. In crosslinking, through the acetoacetate group each aldehyde group of a dialdehyde can react with the active methylene group of the acetoacetoxy moiety or, in the alternative, one of the groups can react with the active methylene functionality and the other with functionality on the substrate, e.g. a diol group of cellulose or polyvinyl alcohol. Examples of aldehydes suited for crosslinking include glutaraldehyde and glyoxal. If glyoxal is used, it typically is added at a level of from about 25 to 125 weight percent of the polymer or from about 50 to 250 wt % when the acetoacetate monomer is considered.

There are numerous polyfunctional aziridinyl compositions that can be used for effecting crosslinking of the polymers containing pendent carboxyl functionality. Representative of polyfunctional aziridines are noted in U.S. Pat. Nos. 4,278,578 and 4,605,698 and are incorporated by reference. Typically these polyfunctional aziridine crosslinking agents are aziridine compounds having from 3 to 5 nitrogen atoms per molecule and N-(aminoalkyl) aziridines such as N-aminoethyl-N-aziridilethylamine, N,N-bis-2-aminopropyl-N-aziridilethylamine, N-3,6,9-triazanonylaziridine and the trifunctional aziridine crosslinker sold under the trademark Neocryl CX100. Other examples include bis and tris aziridines of di and tri acrylates of alkoxylated polyols, such as the trisaziridine of the triacrylate of the adduct of glycerine and 3.8 moles of propylene oxide; the tris aziridine of the triacrylate of the adduct of trimethylolpropone and 3 moles ethylene oxide and the tris aziridine of the triacrylate of the adduct of pentaerythritol and 4.7 moles of propylene oxide.

The operative level for the aziridine functional external crosslinker is quite large, e.g., from 25–250% and higher based upon the weight percent carboxyl functionality. Higher levels of aziridine go unused and add to the cost. The aziridine moieties are capable of reacting with a carboxylic acid group and if at least two aziridine moieties react with carboxylic acid groups on two different polymer chains, the polymer chains are crosslinked.

The dual crosslink feature of the polymer is important to achieve significant cure within an appropriate ambient cure temperature range from 20 to 40° C. In effecting cure, the conditions are controlled to flash the water from the emulsion and then effect cure. Water may be flashed at a temperature from 60 to 80° C. under ambient and reduced pressure and the product removed from the heat source and cure being effected without further addition of heat. The polymer typically cures within seconds.

Although significant cures can be achieved with AAEM as the lone crosslinking functionality in the polymer, the performance is not at levels required for many applications such as high performance paper towels. The same is true when acid functional polymers are crosslinked with polyfunctional aziridines. On the other hand, in systems which have both the acetoacetate and the acid functionality, those treated with both glyoxal and aziridine outperform those with only one functionality, regardless of the level of external crosslinker employed.

The following examples are provided to illustrate preferred examples of the invention and are not intended to restrict the scope thereof. For ease of calculation, it is assumed that the monomer reactants are present in the polymer in the same weight proportions as present in the initial reaction medium.

EXAMPLE 1

Preparation of Carboxyl, AAEM and Ethyl Acrylate Containing Acrylic Polymer

To a 2 L reactor is charged 443.9 g of deionized water, 3.9 g of Aerosol A-102, 0.6 g of sodium citrate, 54.3 g of a pre-emulsion which is comprised of 677.3 g of ethyl acrylate (67%), 203.2 g of methyl methacrylate (20%), 48.4 g of methacrylic acid (4.8%), 79.0 g of AAEM (7.9%), 325.0 g of deionized water, 10.9 g of Aerosol A-102 and 14.4 g of Igepal CO-887 alkyl phenol ethoxylate surfactant. The reactor is heated to 80° C. A delay of 103.3 g of deionized water and 4.70 g of sodium persulfate is slowly added to the reactor at a rate of 0.5 g/minute. When the catalyst delay is started, so is the pre-emulsion delay at a rate of 6.2 g/minute. The delay additions are complete after 3½ hours and the reaction is allowed to continue at temperature for one hour. After the reaction is complete, the contents are allowed to cool.

The solids are 54.1% with a viscosity of 64 cps at 60 rpm with a number 3 LV spindle. The $T_g$ of the polymer is 9° C. (Runs 28 and 39)

EXAMPLE 2

Dual Crosslinking of Polymer

To the emulsion of Example 1, 45.1 g of deionized water, then 7.5 g of glyoxal (a 40% aqueous solution) followed by addition of 1.5 g of a polyaziridine marketed under the trademark Neocryl CX-100 (100% active) is added. The level was 3 g glyoxal per 79 g AAEM or 4% by weight based upon the weight of AAEM and 1.5 grams of aziridine per 48.4 grams or 3.1% based upon acrylic acid. This formulation then is ready to be printed onto a nonwoven basestock. Upon printing, the nonwoven web is placed into an oven at 150° F. for two minutes to remove all of the water. The nonwoven web is removed from the oven and allowed to cool and cure at ambient temperatures; hence, for reference purposes this is ambient cure. Additional heat is not required to effect cure as are conventional crosslink polymer systems in the production of high performance paper towels and other webs.

This formulation provides tensile performance to the nonwoven basestock similar to that achieved by standard heat activated systems. Heat activated systems of the prior art do not provide any tensile performance under similar drying conditions.

EXAMPLE 3

Preparation of Carboxyl, AAEM and Ethyl Acrylate Containing Acrylic Polymer

The procedure of Example 1 is followed essentially the same except the pre-emulsion contains 677.3 g of butyl acrylate rather than ethyl acrylate.

The Tg of this polymer is −14° C., with solids of 51.1% and a viscosity of 90 cps. (Run 32)

EXAMPLE 4

Preparation of Carboxyl, AAEM and Ethyl Acrylate Containing Acrylic Polymer

The procedure of Example 3 is followed except that the alkyl phenol ethoxylate base surfactant, Igepal CO-887, is replaced with an active equivalent amount of Tergitol 15-S-30, an ethoxylated secondary alcohol.

The $T_g$ of this polymer is −15° C., with solids of 51.5% and a viscosity of 114 cps.

EXAMPLE 5

Preparation of Carboxyl, AAEM and Butyl Acrylate Containing Vinyl Acrylic Polymer The procedure of Example 3 is followed except that vinyl acetate is employed in the pre-emulsion: The pre-emulsion now contains a different backbone monomer mix, though everything else is the same. The backbone monomer composition is comprised of 519.5 g of vinyl acetate, 361.0 g of butyl acrylate, 48.4 g methacrylic acid and 79.2 g of AAEM.

This polymer has a $T_g$ of 9° C. with solids of 51.0% and a viscosity of 116 cps.

EXAMPLE 6

Preparation of AAEM Vinyl Acetate and Ethylene Containing Acrylic Polymer

The procedure of Example 4 is followed except that vinyl acetate and ethylene are employed as the basic components of the polymer backbone. To a one-gallon steel reactor is charged 524 g of a 2% aqueous solution of Natrosol 250 HR, 524 g of a 2% aqueous solution of Natrosol 250 LR, 28.0 g of an 80% aqueous solution of Tergitol 15-S-20, 11.2 g of Pluronic L-64, 11.2 g of Pluronic F-68 5.0 g of a 1% aqueous solution of ferrous ammonium sulfate, 0.20 g of a 50% aqueous solution of citric acid, 1.2 g of sodium citrate and 476.0 g of vinyl acetate. The reactor is heated to 50° C. and 250 g of ethylene is added. A 3% aqueous solution of ammonium persulfate is added at 0.2 ml/min and a 10% aqueous solution of sodium formaldehyde sulfoxylate is added at 0.33 ml/min. When initiation occurs, a monomer delay comprised of 74.2 g of AAEM in 1038.8 g of vinyl acetate is added at a rate of 4.6 ml/min for 240 minutes. When the monomer delay is complete, the oxidizer is switched to a 9% aqueous solution of ammonium persulfate and the reaction maintained for an additional hour.

The polymeric emulsion has 50.0% solids, a viscosity of 700 cps and a $T_g$ of −1° C.

EXAMPLE 7

Crosslinking

The polymeric emulsion of Example 6 is diluted to 20.0% solids and treated with 7.5 g of a 40% aqueous solution of glyoxal. The polymer does achieve >90% of total cure under the test conditions, typically either 150° F. for two minutes or 200° F. for 90 seconds. Such conditions are used to flash water from the substrate with cure being effected at ambient temperature.

EXAMPLE 8

Effectiveness of Crosslink Systems in Nonwoven Recreping Applications

A series of emulsions was prepared utilizing a variety of crosslink mechanisms for the purpose of determining whether they were crosslinkable at ambient temperatures and to determine the effectiveness of the crosslink system for cellulosic nonwoven recreping applications. (Ambient temperature cure is defined as the temperature of cure after flash removal of water from the emulsion. On removal from the flash dryer no further heat is applied.) The temperature drops quickly and thus the cure is considered ambient temperature. Specifically, the cellulosic webs were impregnated with various emulsions and incorporating various crosslinking systems were heated in a dryer to 65° C. for about 2 minutes to flash the water form the emulsion. Then, the web was removed from the dryer and allowed to equilibrate to room temperature for a time from 12 to 20 hours. The webs were tested for tensile strength under a variety of conditions utilizing an Instron apparatus. In the measurement of water and solvent resistance of the webs, the webs were immersed in water, in isopropanol and in methylethyl ketone for about 3 minutes, then tested. The results are set forth in Table 1.

| Run | Crosslinking System | Dry Tensile | Wet Tensile | IPA Tensile | MEK Tensile |
|---|---|---|---|---|---|
| 1 | Base Stock (no binder) | 890 | 42 | 495 | NA |
| 2 | NMA + NH4Cl + Heat | 4679 | 2792 | 2747 | 2364 |
| 3 | NMA + NH4Cl | 2023 | 286 | 1065 | 605 |
| 4 | A-105 + 10% Epoxy Resin | 1825 | 272 | | |
| 5 | A-105 + 20% Epoxy Resin | 1804 | 521 | | |
| 6 | ACP-66 + Heat | 5712 | 808 | 1296 | 549 |
| 7 | ACP-66 + 3% ZrSalt + Heat | 5353 | 1211 | 1731 | 915 |
| 8 | ACP-66 | 5784 | 196 | 1115 | 524 |
| 9 | ACP-66 + 3% Zr Salt | 5201 | 322 | 1548 | 687 |
| 10 | VTIPS | 1501 | 315 | | |
| 11 | VTIPS + Heat | 1648 | 1208 | | |
| 12 | A-426 + Heat | 3949 | 646 | 1061 | 871 |
| 13 | A-426 | 3823 | 148 | 1147 | 931 |
| 14 | A-426 + 3% ZrSalt + Heat | 3125 | 633 | 1128 | 876 |
| 15 | A-426 + 3% Zr Salt | 3181 | 276 | 1171 | 867 |
| 16 | AA + PVOH + Heat | 6299 | 1031 | 1781 | 1024 |
| 17 | AA + PVOH | 5779 | 179 | 1743 | 1014 |
| 18 | AA + PVOH + Zr Salt + Heat | 4864 | 976 | 1814 | 1085 |
| 19 | AA + PVOH + Zr Salt | 5025 | 376 | 1832 | 1089 |
| 20 | AA + PVOH + Zn Salt | 4407 | 109 | 2393 | 1423 |
| 21 | CEA + PVOH + Zr Salt | 4017 | 272 | 1552 | 1074 |
| 22 | CEA + PVOH + Zn Salt | 4633 | 186 | 2501 | 1576 |
| 23 | ABDA | 5067 | 788 | 1618 | 1045 |
| 24 | AAEM + AA + PVOH + 5% CX-100 | 5468 | 1057 | 2783 | 1897 |
| 25 | AAEM + M + PVOH + 7.5% CX-100 | 5781 | 881 | 3033 | 2047 |
| 26 | AAEM + AA + PVOH + 5% Glyoxal | 5316 | 1732 | 2082 | 1220 |
| 27 | AAEM + AA + PVOH + 5% Glyoxal + 5% CX-100 | 4074 | 1685 | 2547 | 1823 |
| 28 | 8% MEM + 5% MM+ 5% Glyoxal + 5% CX-100 | 7025 | 2910 | 3599 | 2241 |
| 29 | 8% AAEM + 5% MAA+ PVOH + 5% Glyoxal + 5% CX-100 | 4030 | 1938 | 2815 | 2044 |
| 30 | 8% MEM + 5% MAA + PVOH + 10% Glyoxal + 5% CX-100 | 3773 | 2325 | 2600 | 2092 |
| 31 | 8% AAEM + 5% MAA+ PVOH + 5% Glyoxal + 10% CX-100 | 3631 | 1683 | 2529 | 1922 |
| 32 | 8% AAEM + 5% MAA+ PVOH + 2.5% Glyoxal + 5% CX-100 | 3597 | 1670 | 2144 | 1771 |
| 33 | 8% AAEM + 5% MAA | 6079 | 4171 | 3938 | 2367 |
| 34 | 4% AAEM + 5% MAA | 3517 | 3020 | 2375 | 1384 |
| 35 | 8% AAEM + 2.5% MAA | 4035 | 2589 | 2605 | 1755 |
| 36 | 4% AAEM + 2.5% MAA | 4543 | 2827 | 1752 | 1038 |
| | Sample 39–42 were cured with 10% glyoxal and 5% CX-100 | | | | |

-continued

| Run | Crosslinking System | Dry Tensile | Wet Tensile | IPA Tensile | MEK Tensile |
|---|---|---|---|---|---|

In Table 1 the following abbreviations are employed:
ACP-66 identifies a commercial acrylic polymeric emulsion which is rich (7.5%) in carboxylic acid groups.
Bacote 20 identifies a Zr salt, ammonium zirconium carbonate,
MAMD is a low formaldehyde version of N-methylolacrylamide; and is actually close to being a 50:50 mixture of acrylamide and N-methylolacrylamide.
PAM identifies a commercial polyacrylamide
Fomrez UL-22 identifies a commercial organotin compound sold by Witco Chemicals.
A-426 identifies a surfactant stabilized vinyl acetate/ethylene copolymer having a Tg of 0° C. with ~5% acrylic acid functionality.
AA is acrylic acid.
MAA is methacrylic acid.
CEA is carboxyethyl acrylate.
ABAA is aminobutyraldehyde alkyl acetal
ABDA is acrylamidobutyraldehyde dialkyl acetal
Jeffamine 100 identifies a commercial polyethylene oxide chain capped at both ends with a primary amine so that the end group is a primary amine.
VTIPS is vinyl trisisopropoxy silane From Table 1 the following can be noted.

Run 1 is a comparative run showing the properties of a web having no binder. Runs 2– show comparative crosslinking systems and in effect defines the target properties of the cure product in a DRC process. Specifically, the properties should be within a range of from 4000 to 5500 dry tensile, 200 to 3500 wet tensile, 2200 to 3200 isopropanol tensile, and 2000 to 3000 methylethyl ketone tensile.

Runs 10 to 11 show that the vinyl trisisopropoxy silane monomer was incorporated into a vinyl acetate/ethylene copolymer and treated with varying levels of a catalytic amount of organotin compounds (Fomrez UL-22, sold by Witco Chemicals). However, these systems did not demonstrate any cure in the time frames needed for a double recreping (DRC) binder. While this system may be acceptable for certain coatings, they are unacceptable for other and certainly DRC binder. Even when VTIPS is promoted, the data indicates that up to three weeks at ambient conditions may be needed to reach full cure. For many coating applications, the surface could be severely marred by twigs, animals, leaves, or inadvertent touches by humans before sufficient cure is reached.

Polymers loaded with carboxylic acid functionality did not demonstrate any low temperature cure when treated with varying quantities of zirconium ammonium carbonate or the zinc equivalent. They did provide decent cures when heated. However, even when the acid functionality was repositioned away from the polymer backbone by using carboxyethyl acrylate as the source of the carboxylic acid group, those systems still did not generate any appreciable level of low temperature cure with the heavy metal salts. Similar results were obtained when epoxy resins were added to our standard binders.

Runs 30–33 show the effect of the polyvinyl alcohol exhibits reduced wet tensile strength as one might expect. Nonetheless, the polymers cured quickly and gave good tensiles.

Runs 21, 22 and 27–37 show the effect of glyoxal on the final product. As one might expect higher levels of crosslinking agent drive the reaction to completion and effecting a greater degree of cure in a given time.

Run 23, as well as 20, 22 and 27–37 show the effect of the aziridine level as one of the crosslinking agents.

Runs 23, 35 and 37 show the effect of the molar level of acetoacetate and carboxyl level in terms of cure.

A combination of more than one cure chemistry allows the preparation of a system which gives a stable formulation for pot life and which meets the target performance requirements for cure at ambient temperature. The combination of these two methods of crosslinking a polymer allows less of each type of crosslinker to be employed.

What is claimed is:

1. In a process for forming a nonwoven web bonded with a crosslinkable polymeric emulsion containing a crosslinkable polymer wherein a polymeric emulsion is applied to the nonwoven web, the water removed, and the crosslinkable polymer subsequently crosslinked, the improvement which comprises:

utilizing a polymeric emulsion wherein the crosslinkable polymer incorporates acetoacetate functionality and carboxylic acid functionality; and crosslinking the acetoacetate in the crosslinkable polymer by reaction with an effective amount of a polyaldehyde and crosslinking the carboxylic acid functionality by reaction with an effective amount of a polyaziridine compound.

2. The process of claim 1 wherein the polyaldehyde employed for crosslinking the acetoacetate functionality in said crosslinkable polymer is a dialdehyde.

3. The process of claim 1 wherein the acetoacetate functionality is present in said crosslinkable polymer in an amount of from 1 to 10% by weight of the crosslinkable polymer, said acetoacetate functionality relative to the molecular weight of the monomer acetoacetoxyethyl methacrylate.

4. The process of claim 3 wherein the acetoacetate functionality is provided by acetoacetoxyethyl methacrylate.

5. The process of claim 2 wherein the dialdehyde is glyoxal or glutaraldehyde.

6. The process of claim 4 wherein the carboxyl functionality is present in said crosslinkable polymer in an amount of from 0.5–5% of total monomers by weight, said amount relative to the molecular weight of acrylic acid.

7. The process of claim 6 wherein the polyaziridine compound is selected from the group consisting of branched organic backbones with several pendant, chemically bound ethylene or propylene imine groups attached.

8. The process of claim 1 wherein the nonwoven web is a cellulosic web and the polymer is comprised of polymerized units of the following monomers and are polymerized in the following weight percentages:

| | |
|---|---|
| Vinyl Acetate | 0–90 wt % |
| (Meth)Acrylic Acid | 1–10 wt % |
| Acetoacetoxyethyl (Meth)ethacrylate | 2–10 wt % |
| $C_{1-8}$ alkyl (Meth)Acrylic Ester | 0–90 wt % |
| and the sum of said monomers is 100%. | |

9. The process of claim 8 wherein the polyaldehyde employed for effecting cure of the acetoacetate functionality in said crosslinkable polymer is glutaraldehyde or glyoxal.

10. The process of claim 9 wherein the dialdehyde is employed in an amount of from about 50 to 250 wt % based upon the weight of the acetoacetate monomer polymerized into the crosslinkable polymer.

11. The process of claim 9 wherein the polyaziridine compound is selected from the group consisting of N-aminoethyl-N-aziridilethylamine, N,N-bis-2-aminopropyl-N-aziridilethylamine, N-3,6,9-triazanonylaziridine, the bis and tris aziridines of di and tri acrylates of alkoxylated polyols, the trisaziridine of the triacrylate of the adduct of glycerine and propylene oxide; the trisaziridine of the triacrylate of the adduct of trimethylolpropane and ethylene oxide and the trisaziridine of the triacrylate of the adduct of pentaerythritol and propylene oxide.

12. The process of claim 11 wherein the monomers polymerized into the crosslinkable polymer are:

| | |
|---|---|
| Vinyl Acetate | 35–85 wt % |
| (Meth)Acrylic Acid | 3–8 wt % |
| Acetoacetoxyethyl (Meth)ethacrylate | 4–8 wt % |
| $C_{1-8}$ alkyl (Meth)Acrylic Ester | 0–40 wt % |

13. The process of claim 11 wherein the monomers are selected from the group consisting of:

| | |
|---|---|
| (meth)acrylic acid | 1–10 wt % |
| methacrylate | 10–30 wt % |
| ethyl or butyl acrylate | 40–75 wt % |
| acetoacetoxy ethyl methacrylate | 2–10 wt % |

14. The process of claim 13 wherein the monomers are polymerized into the crosslinkable polymer in the following amounts:

| | |
|---|---|
| (meth)acrylic acid | 3–7 wt % |
| methacrylate | 15–25 wt % |
| ethyl or butyl acrylate | 55–65 wt % |
| acetoacetoxy ethyl methacrylate | 5–8 wt % |

15. The process of claim 14 wherein the polyaziridine compound is selected from the group consisting of N-aminoethyl-N-aziridilethylamine, N,N-bis-2-aminopropyl-N-aziridilethylamine, N-3,6,9-triazanonylaziridine, the bis and tris aziridines of di and tri acrylates of alkoxylated polyols, the trisaziridine of the triacrylate of the adduct of glycerine and propylene oxide; the trisaziridine of the triacrylate of the adduct of trimethylolpropane and ethylene oxide and the tris aziridine of the triacrylate of the adduct of pentaerythritol and propylene oxide.

16. The process of claim 13 wherein the number average molecular weight of the polymer is from 7500 to 10,000.

* * * * *